US007388176B2

(12) United States Patent
Chen

(10) Patent No.: US 7,388,176 B2
(45) Date of Patent: Jun. 17, 2008

(54) HEATING DEVICE WITH THIN HEATING BOARDS

(76) Inventor: Ching-Song Chen, No. 29, Route 21, Industrial Park, Nan-Tun, Taichung (TW)

( * ) Notice: Subject to any disclaimer, the term of this patent is extended or adjusted under 35 U.S.C. 154(b) by 194 days.

(21) Appl. No.: 11/401,378

(22) Filed: Apr. 11, 2006

(65) Prior Publication Data

US 2007/0235439 A1 Oct. 11, 2007

(51) Int. Cl.
*H05B 3/68* (2006.01)
*F24D 15/02* (2006.01)

(52) U.S. Cl. ..... 219/450.1; 219/385; 219/387; 219/386; 219/521; 219/526; 219/528; 219/529; 219/540; 219/541; 219/552; 219/506; 219/480; 392/420; 392/365; 392/366; 392/369; 392/373; 392/374

(58) Field of Classification Search ..... 219/450.1, 219/385–7, 521, 526, 528–33, 536–38, 540–41, 219/552, 480, 506, 508; 392/420, 365–9, 392/360, 373–4
See application file for complete search history.

(56) References Cited

U.S. PATENT DOCUMENTS 3,961,157 A * 6/1976 Miller et al. ..... 392/435
4,860,434 A * 8/1989 Louison et al. ..... 29/611
5,138,134 A * 8/1992 Ellison ..... 392/448

* cited by examiner

*Primary Examiner*—Shawntina Fuqua
(74) *Attorney, Agent, or Firm*—Theodore F. Shiells

(57) ABSTRACT

A heating device includes a case having a plurality of openings and a plurality of slits are defined in bars of the case so that a plurality of heating boards are engaged with the slits of the case at an equal distance. A power control device is connected to the case and includes a power line having a plurality of male connectors. Each heating board includes a heating layer sandwiched between two isolation plates. Two wires are connected to the heating layer and each wire has female connectors, which are connected with the male connectors of the power line. The heating layers of the heating boards dispense heat evenly from the openings of the case.

13 Claims, 9 Drawing Sheets

HEATING DEVICE WITH THIN HEATING BOARDS

BACKGROUND OF THE INVENTION

1. Field of the Invention

The present invention relates to a heating device equipped with thin heating boards that include graphite layer electrically connected with a power control device so as to dispense even and warm heat energy.

2. The Prior Arts

FIG. 1 shows a conventional heater 10, which includes a case with a curved reflection board 13 and a quartz tube 11 is connected between two sidewalls of the case. The quartz tube 11 can be heated to very high temperature so that a plurality of separation grids are used to separate users and the quartz tube 11. The grids are arranged to have a certain width of gaps so as to let the heat to be reflected toward the users. However, the quartz tube 11 might burn flammable material such as paper sheets or even burn the users who unintentionally touch the quartz tube 11. Besides, only a short distance in front of the heater 10 feels the heat.

FIG. 2 shows another heater 20, which includes a plurality of blades 21 and oil is circulated between the blades 21. A heating device 22 is used to heat the oil and the oil circulates through the blades 21 to heat the blades 21 and then, to make heat exchange with the air. The oil is evenly heated and does not have very high temperature so that it will not burn the users. However, the efficiency of heat transferring is low. Most of the blades 21 are coated with a layer of baking vanish which reduces the heat transferring from the blades 21 to the air. Besides, the heater 20 is not an energy saving heater.

FIG. 3 shows yet another heater 30, which is used in a sauna cabinet and includes a plurality of heating tubes 31 which are heated to a high temperature and the case 32 has an open top with grids thereon. Stones 33 are put on the grids to absorb the heat from the heating tubes 31 and release far infrared beams. The stones 33 might burn the users and the far infrared is limited because the stones 33 include limited surfaces. Due to the high temperature of the heating tubes 31, the gap between the heating tubes 31 and the insides of the case 32 has to be wide enough so that the case 32 is bulky.

The present invention intends to provide a heating device that has a compact size and the heating boards are so thin that the heat can be efficiently dispensed and do not hurt the users.

SUMMARY OF THE INVENTION

A primary objective of the present invention is to provide a heating device that comprises a case with a plurality of openings and a plurality of heating boards are installed in the case at an equal distance and each heating board includes a heating layer which is sandwiched between two isolation plates. Two wires are connected to the heating layer and each wire has a female connector so as to be connected with a male connector of a power line of a power control device connected to the case.

BRIEF DESCRIPTION OF THE DRAWINGS

The present invention will be apparent to those skilled in the art by reading the following detailed description of a preferred embodiment thereof, with reference to the attached drawings, in which.

DETAILED DESCRIPTION OF THE PREFERRED EMBODIMENT

Figure 1:
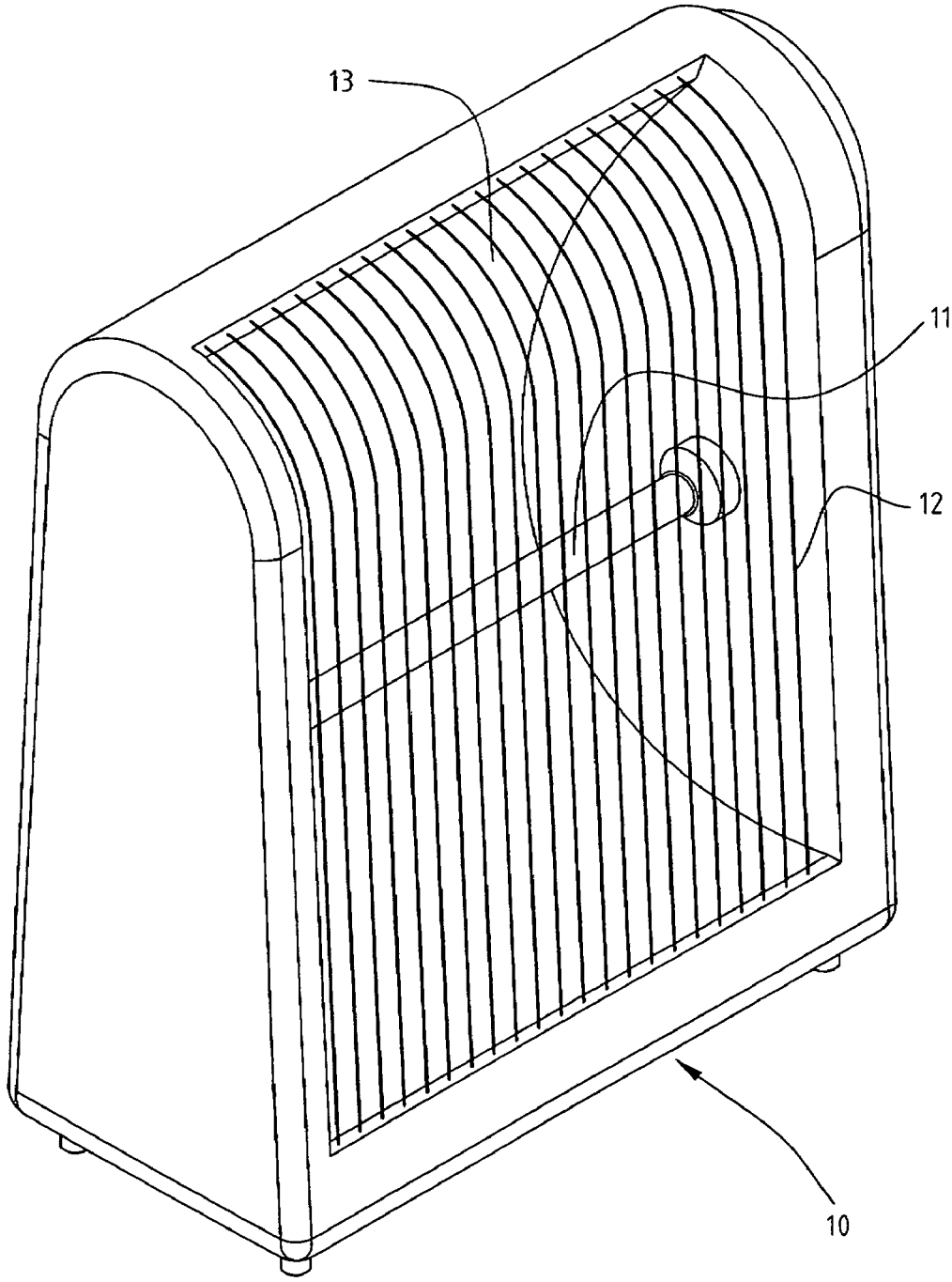
FIG. 1(Prior Art)
FIG. 1 shows a first conventional heater.
Figure 2:
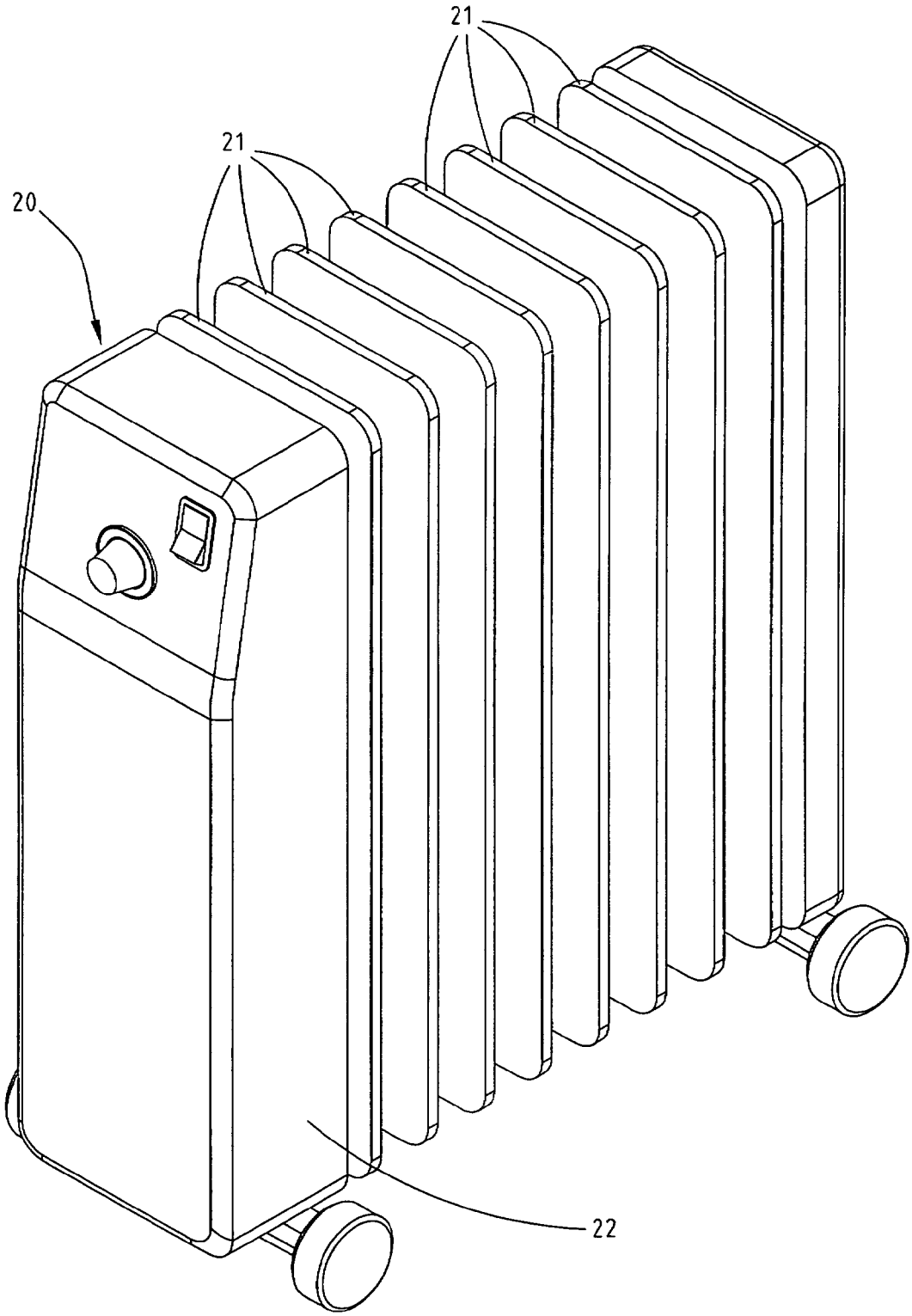
FIG. 2(Prior Art)
FIG. 2 shows a second conventional heater.
Figure 3:
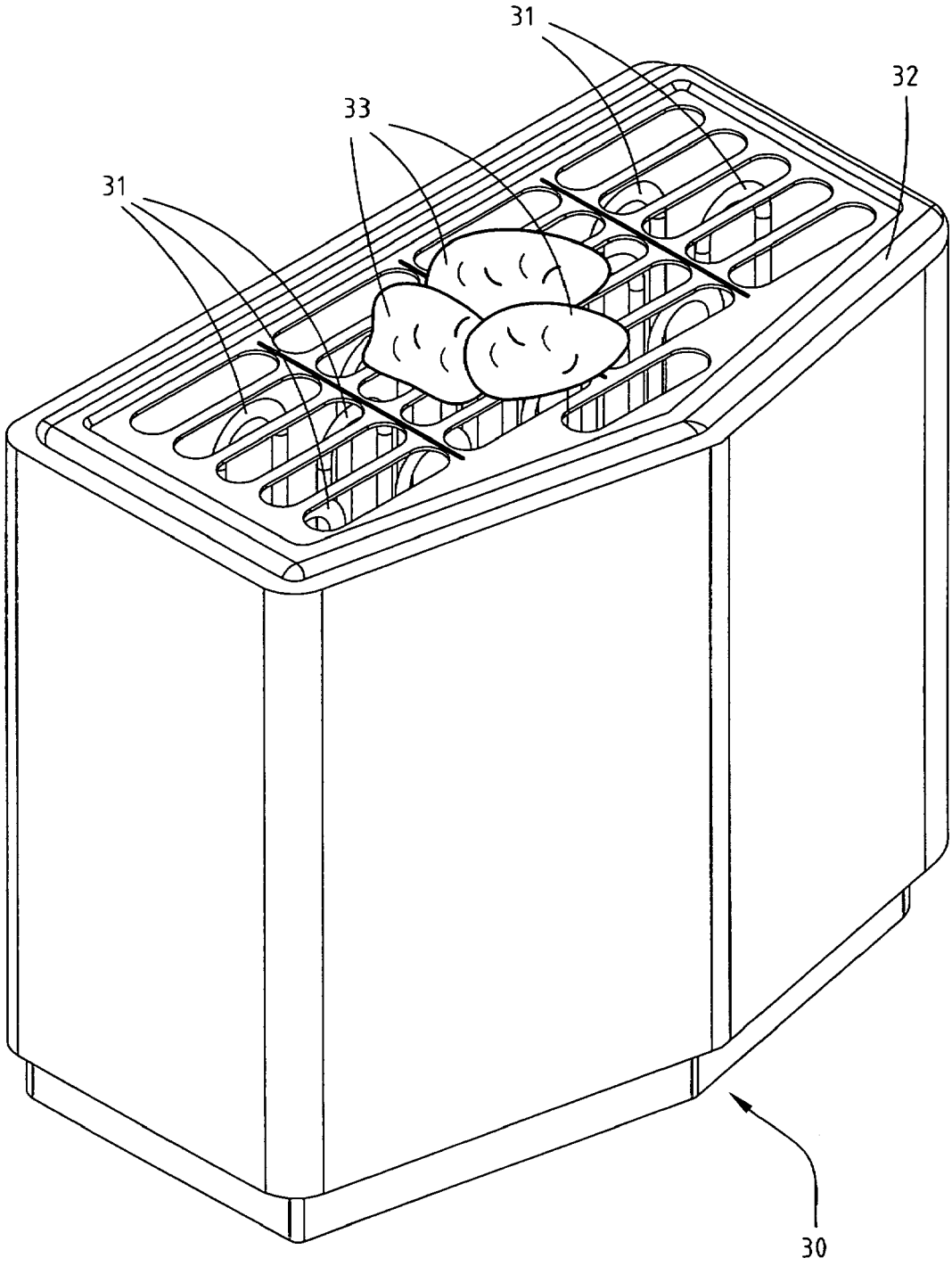
FIG. 3(Prior Art)
FIG. 3 shows a third conventional heater.
Figure 4:
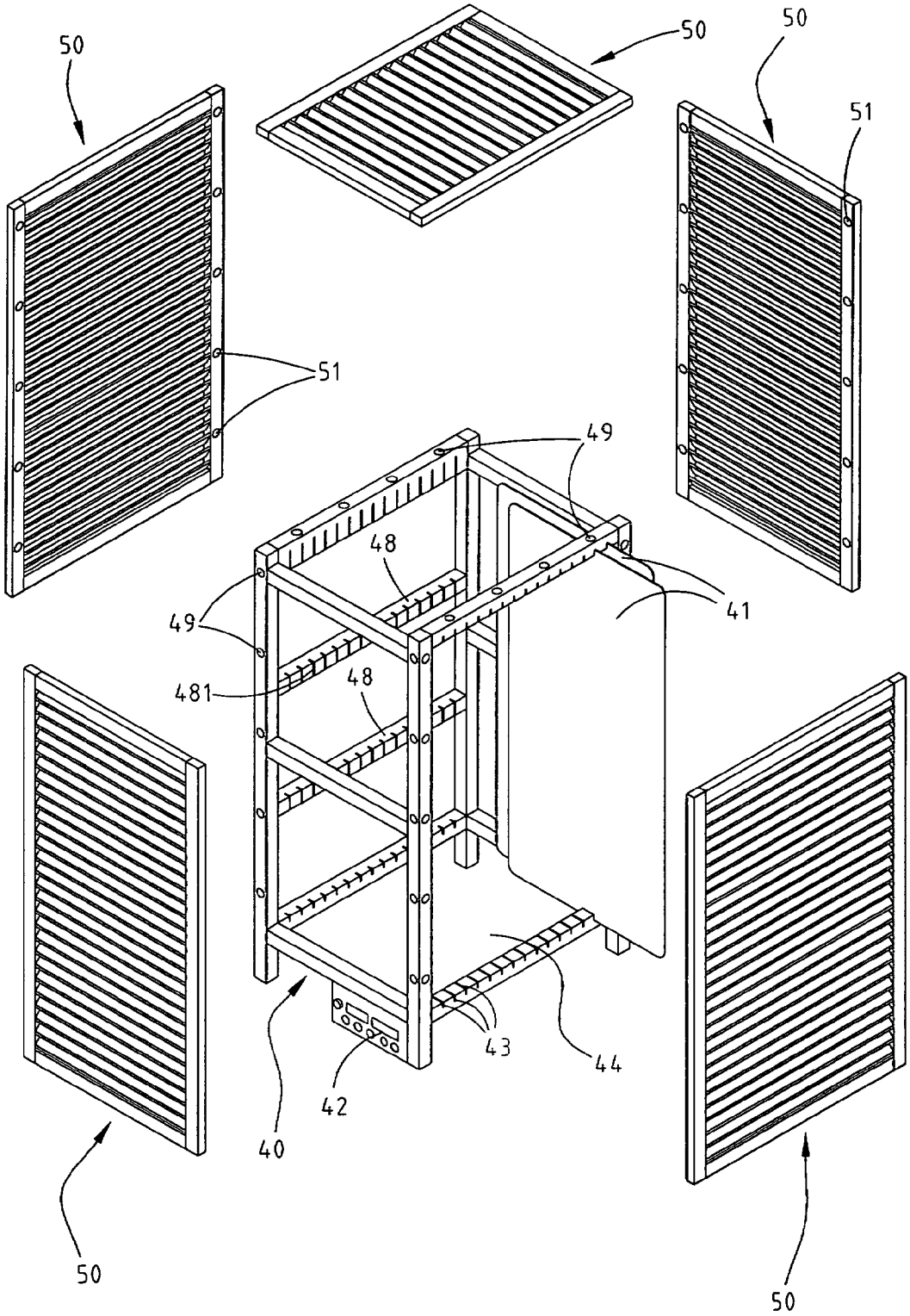
FIG. 4 is an exploded perspective view of a heating device in accordance with the present invention.
Figure 5:
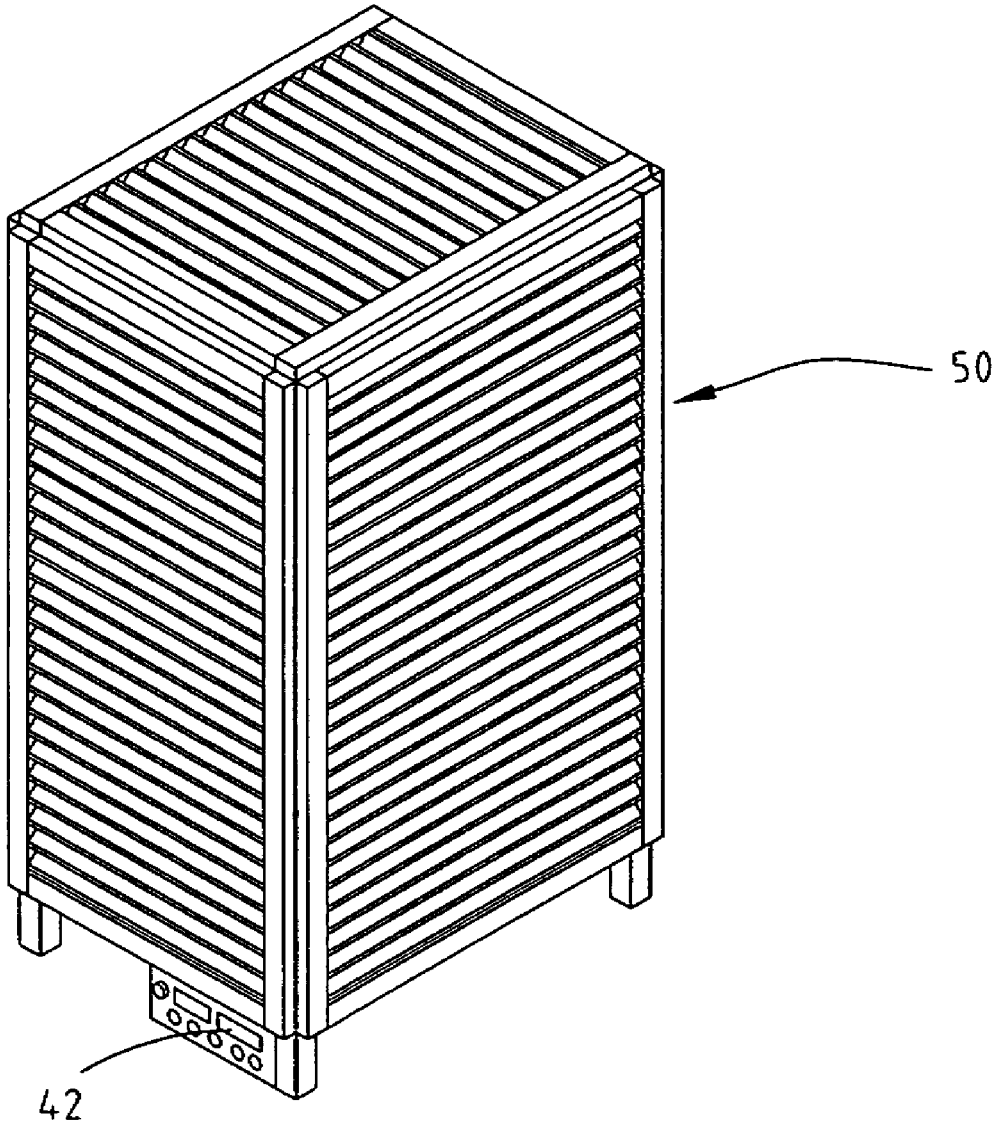
FIG. 5 shows a perspective view of the heating device of the present invention.

With reference to the drawings and in particular to FIGS. 4 and 5, the heating device in accordance with the present invention comprises a rectangular case 40 which is composed of a plurality of posts and transverse bars 48 and, a plurality of openings 44 are defined between the posts and the transverse bars 48 in four vertical sides and a top of the case 40. The case 40 is made by plastic or wood. A power control device 42 is connected to a lower end of the case 40 and includes a power line 454, which has a plurality of male connectors 455. A plurality of slits 43 are defined in the transverse bars 48 on the front side and the rear side of the case 40. A plurality of heating boards 41 are slidably engaged with the slits 43 and a distance between the adjacent slits 43 is between 0.5 cm to 2.5 cm, so that the heating boards 41 are installed to the case 40 at an equal distance.

Figure 6:
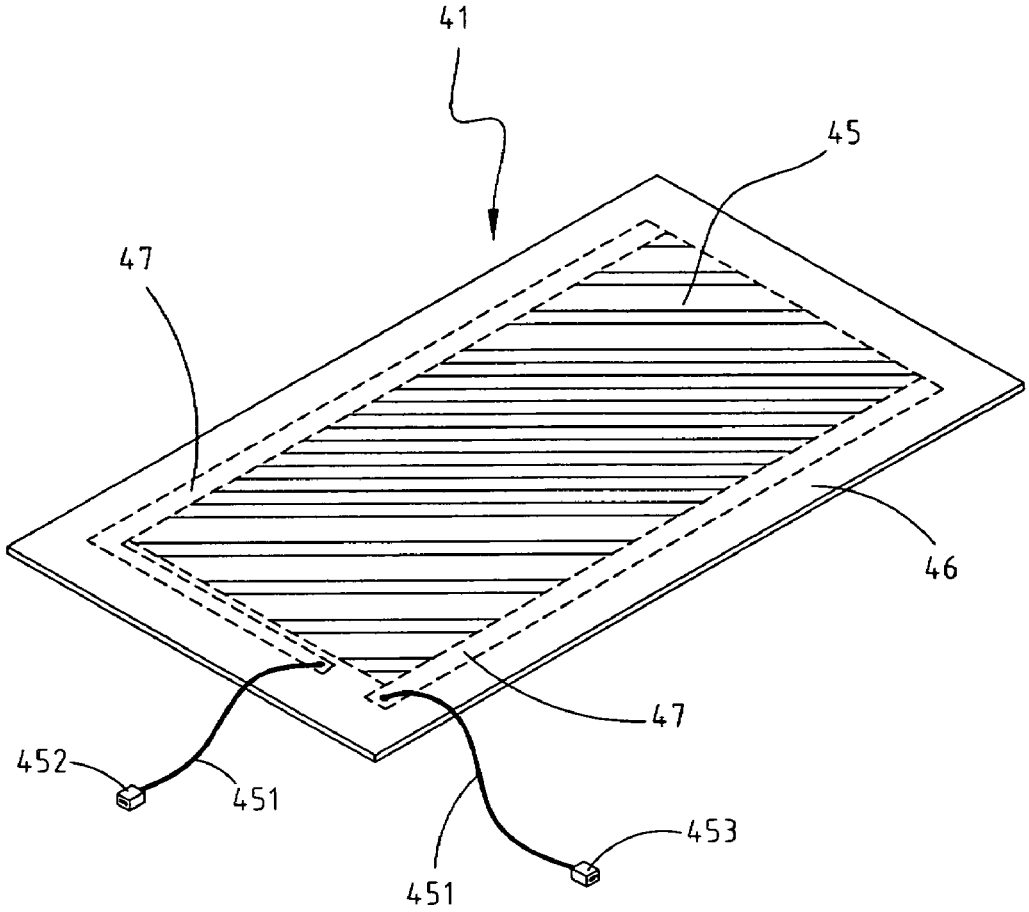
FIG. 6 shows a heating board of the heating device of the present invention.
Figure 7:
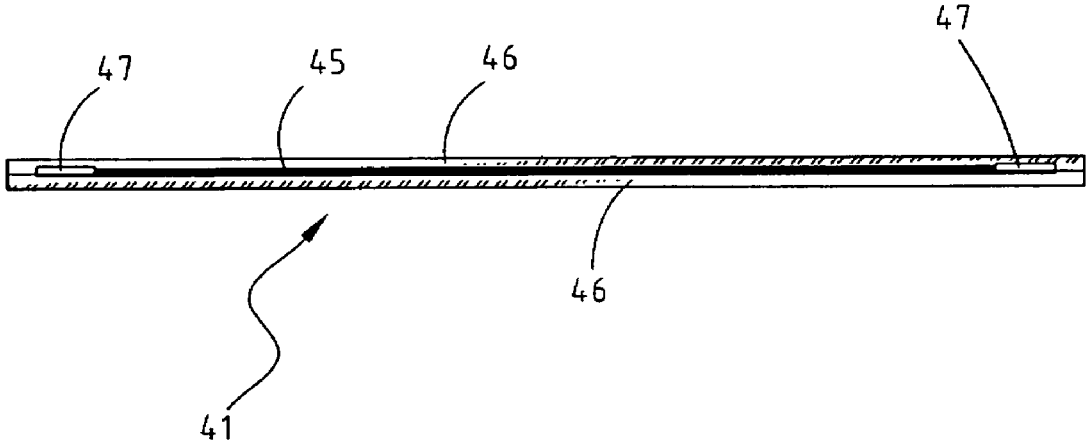
FIG. 7 shows a cross sectional view of the heating boarding of the present invention.
Figure 8:
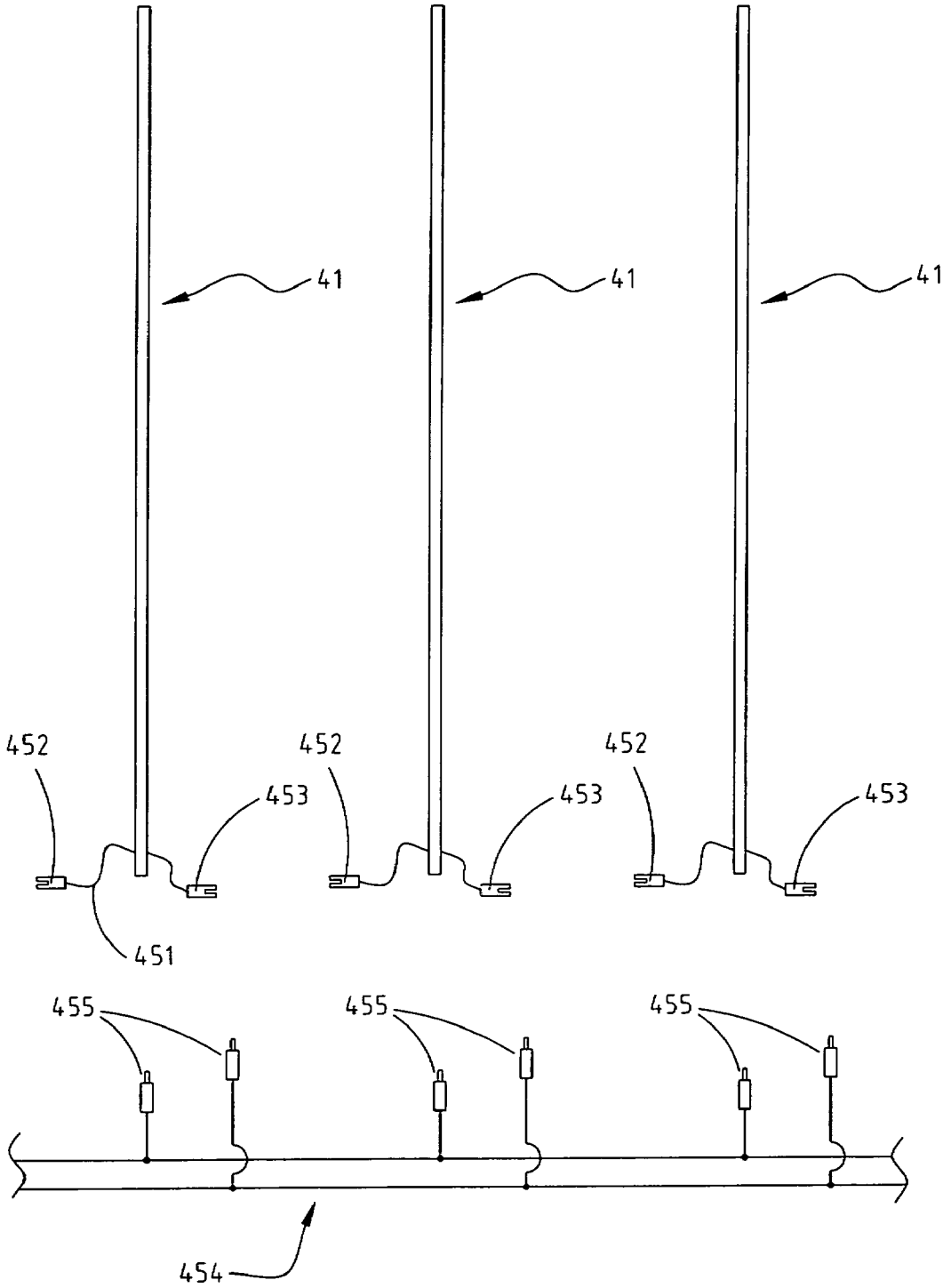
FIG. 8 shows that female connectors of the heating board and male connectors of a power line of the present invention are to be connected in parallel with each other.

Referring to FIGS. 6 to 8, the each heating board 41 includes a heating layer 45, which is sandwiched between two isolation plates 46. The heating layer 45 is a graphite layer, which can be printed on the two facing sides of the isolation layers 46 and the isolation plates 46 are made by glass fiber. The heating boards 41 each have a thickness less than 1 mm so that the heating boards 41 can be arranged in parallel at desired gap. A copper portion 47 encloses the heating layer 45 and has two separated distal ends to which two wires 451 are connected. Each wire 451 has two female connectors 452, 453 which are connected with the male connectors 455 of the power line 454 to connect the heating boards 41 in parallel.

Figure 4A:
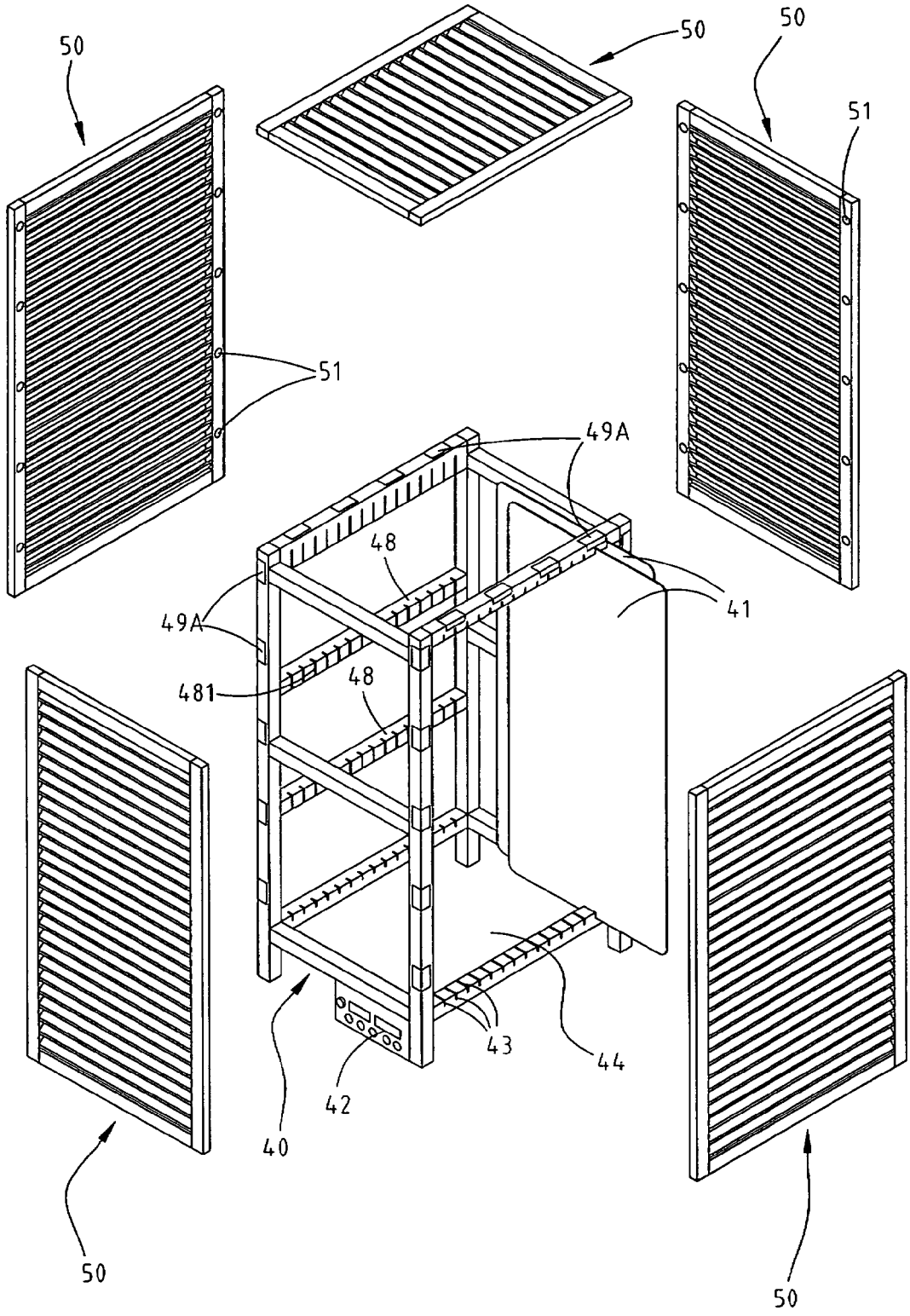
FIG. 4A shows another way for connecting covers to a case of the heating device of the present invention.

The openings 44 of the case 40 are covered by covers 50 and each cover 50 includes a plurality of holes or plates between which slots are defined. The heat is released from the holes or the slots. A plurality of first magnets 49 are located on the transverse bars 48 and the posts of the case 40 and the covers 50 have second magnets 51 which are connected to the first magnets 49. Therefore, the covers 50 can be easily removed from the case 40 when needed. As shown in FIG. 4A, the first magnets 49 can be replaced with a plurality of metal plates 49A located on the case 40 and the covers 50 have second magnets 51 which are connected to the metal plates 49A.

The heating device uses thin heating boards 41 so that the size of the heating device is compact and the heating boards 41 are easily to be removed from the case 40 to be cleaned. The heating layer 45 is heated by controlling the power control device 42 and the heat is transferred via the isolation plates 46 and dispensed via the slots or holes of the covers 50. The heating boards 41 have larger area for dispensing the heat so that the heating device has better efficiency than the conventional heaters. The temperature of the heating boards 41 can be controlled by operating the power control device 42 so as to meet different needs such as in sauna cabinets or used in homes. The heat from the heating boards 41 is transferred by radiation and convection so that less energy is lost. The heating layers 45 generate far infrared energy by the electric power which is directly provided to the heating layers 45 so that the energy cost is more efficient than the conventional heaters. The users can touch the heating boards 41 without worry of being burned and the thin heating boards 41 allow the users to install multiple heating boards 41 with less space. When used in sauna cabinets, there will be no need to put stones on the heating device and the area for dispensing the far infrared energy is much larger than the area of the stones. The heating boards 41 are connected in parallel with each other so that the number of the heating boards 41 can be easily adjusted as needed.

Although the present invention has been described with reference to the preferred embodiment thereof, it is apparent to those skilled in the art that a variety of modifications and changes may be made without departing from the scope of the present invention which is intended to be defined by the appended claims.

What is claimed is:

1. A heating device comprising:

a case having a plurality of openings;

a power line having a plurality of first connectors;

a plurality of heating boards installed in the case at an equal distance and each heating board including a heating layer, the heating layer being sandwiched between two isolation plates, two wires connected to the heating layer and each wire having second connectors which are connected with the first connectors of the power line to connect the heating boards in parallel.

2. The heating device as claimed in claim 1, wherein the case is a rectangle case and the openings are defined in four vertical sides and a top of the case.

3. The heating device as claimed in claim 2, wherein the openings are covered by covers.

4. The heating device as claimed in claim 3, wherein a plurality of first magnets are located on the case and the covers have second magnets which are connected to the first magnets.

5. The heating device as claimed in claim 3, wherein a plurality of metal plates are located on the case and the covers have second magnets which are connected to the metal plates.

6. The heating device as claimed in claim 3, wherein each of the covers includes a plurality of plates between which slots are defined.

7. The heating device as claimed in claim 3, wherein each of the covers includes a plurality of holes.

8. The heating device as claimed in claim 1, wherein the case includes a plurality of slits defined in transverse bars on a front side and a rear side of the case, the heating boards are engaged with the slits.

9. The heating device as claimed in claim 1, wherein the case has a power control device and the power line is connected to the power control device.

10. The heating device as claimed in claim 1, wherein the heating layer is a graphite layer.

11. The heating device as claimed in claim 1, wherein the isolation plates are made by glass fiber.

12. The heating device as claimed in claim 1, wherein the heating boards each have a thickness less than 1 mm.

13. The heating device as claimed in claim 8, wherein a distance between the slits is between 0.5 cm and 2.5 cm.

* * * * *